US009719237B2

(12) United States Patent
Hsu

(10) Patent No.: US 9,719,237 B2
(45) Date of Patent: Aug. 1, 2017

(54) TOOL FOR REMOVING HAIR FROM A DRAIN

(71) Applicant: SDY International Co., Ltd., Taichung (TW)

(72) Inventor: Wei-Tien Hsu, Taichung (TW)

(73) Assignee: SDY International Co., Ltd., Taichung (TW)

( * ) Notice: Subject to any disclaimer, the term of this patent is extended or adjusted under 35 U.S.C. 154(b) by 0 days.

(21) Appl. No.: 14/813,599

(22) Filed: Jul. 30, 2015

(65) Prior Publication Data

US 2017/0030061 A1 Feb. 2, 2017

(51) Int. Cl.
*E03C 1/302* (2006.01)
*B08B 9/043* (2006.01)

(52) U.S. Cl.
CPC ..... *E03C 1/302* (2013.01); *B08B 9/0436* (2013.01)

(58) Field of Classification Search
CPC ..... E03C 1/302; E03C 1/30
USPC ..... 15/104.33, 104.32
See application file for complete search history.

(56) References Cited

U.S. PATENT DOCUMENTS

| | | | | |
|---|---|---|---|---|
| 5,836,032 | A | 11/1998 | Hondo | |
| 6,775,873 | B2 | 8/2004 | Luoma | |
| D511,278 | S * | 11/2005 | Carfagnini | D8/19 |
| D657,099 | S * | 4/2012 | Zach | D32/14 |
| 8,365,337 | B2 * | 2/2013 | Tash | B08B 9/045 15/104.001 |
| 9,217,243 | B2 * | 12/2015 | Gwen | E03C 1/302 |

* cited by examiner

*Primary Examiner* — Laura C Guidotti
(74) *Attorney, Agent, or Firm* — Alan D. Kamrath; Kamrath IP Lawfirm, P.A.

(57) ABSTRACT

A tool for removing hair from a drain includes an elongate pole, a grappler part, a barb unit, and a handle. The grappler part is provided at a front end of the elongate pole and includes a head end and a grappler protruding from a side of the elongate pole. The head end of the grappler part has a curved, arrowhead, or hooked end plane. The barb unit provided on the elongate pole is adjacent to the grappler part and includes a plurality of barbs aligned with the grappler of the grappler part at the same side of the elongate pole. The handle provided at a rear end of the elongate pole includes a pointer for indicating orientation of the barbs and the grapplers of the grappler part. The tool can be smoothly operated by a user for effective removal of congested hair from a drain.

3 Claims, 6 Drawing Sheets

TOOL FOR REMOVING HAIR FROM A DRAIN

BACKGROUND OF THE INVENTION

1. Field of the Invention

The present invention relates to a tool for removing hair from a drain and, more particularly, to a tool with which trash and hair inside a drain can be removed.

2. Description of the Related Art

U.S. Pat. Nos. 5,836,032 and 6,775,873 respectively disclose an apparatus for removing hair from a drain which is used to remove hair or trash inside a drain connected to a sink, a bathtub or a shower.

The conventional apparatus for removing hair from a drain (as disclosed in U.S. Pat. No. 6,775,873) includes an elongate, flexible strip with an attached handle. A number of barbed portions is dispersed along the length of the flexible strip, with the barbed portions alternating along the two sides of the strip. The barbed portions are oriented at an acute angle to the longitudinal axis of the strip, with the vertex of the angle pointing away from the handle. The barbed portions serve to grip hair in a drain which is connected to a kitchen counter, a washbasin or a bathtub, with the hair being removed when the apparatus is removed from the drain. A drain, however, is usually divided into several sections with distinct calibers which link one another with adapters and elbows. In practice, the conventional apparatus for removing hair from a drain is inconveniently operated and may lose gathered hair inside the drain, because the barbed portions alternately arranged at both sides of the strip tend to be jammed at a junction of two connected pipes. Another drawback is that most barbed portions alternately arranged at both sides of the rear end of the strip, except the barbed portions at the front end of the strip, do not work well but injure a hand of a user who operates the apparatus.

BRIEF SUMMARY OF THE INVENTION

Thus, an objective of the present invention is to provide a tool for removing hair from a drain which can be smoothly operated by a user for effective removal of congested hair from a drain and has characteristics of a simple structure and a low-cost advantage.

To achieve this and other objectives, a tool for removing hair from a drain of the present invention includes an elongate pole, a grappler part, a barb unit, and a handle. The elongate pole includes a front end and a rear end spaced from the front end in a lengthwise direction of the elongate pole. The grappler part is provided at the front end of the elongate pole and includes a head end and at least one grappler protruding from a side of the elongate pole. The head end of the grappler part has a curved, arrowhead, or hooked end plane. The barb unit is provided on the side of the elongate pole and adjacent to the front end of the elongate pole. The barb unit includes a plurality of barbs spaced from one another in the lengthwise direction of the elongate pole and aligned with the at least one grappler of the grappler part along the side in the lengthwise direction of the elongate pole. The handle is provided at the rear end of the elongate pole and includes a pointer for indicating orientation of the barbs and the grapplers of the grappler part. As such, a drain congested with hair is cleaned effectively, because the tangled hair can be removed from the drain by the grapplers of the grappler part and the barbs of the barb unit, both of which pick up hair inside the drain when the front end of the elongate pole is inserted into the drain to be cleaned.

In a preferred form, the elongate pole has no barb at a back opposite to the side of the elongate pole. The handle includes a hand hole and two curved concaves formed at a front end plane of the handle and beside the rear end of the elongate pole. The pointer is a through-hole provided in the handle and generally aligned with the barbs of the barb unit along the side in the lengthwise direction of the elongate pole.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
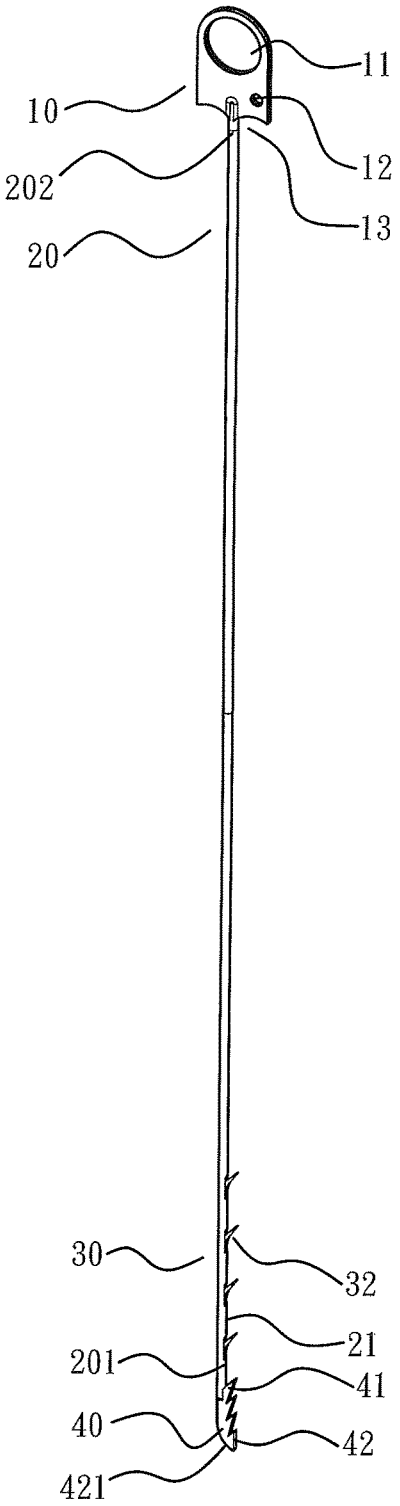
FIG. 1 is a schematic, perspective view of a tool for removing hair from a drain in accordance with a first embodiment of the present invention.
Figure 2:
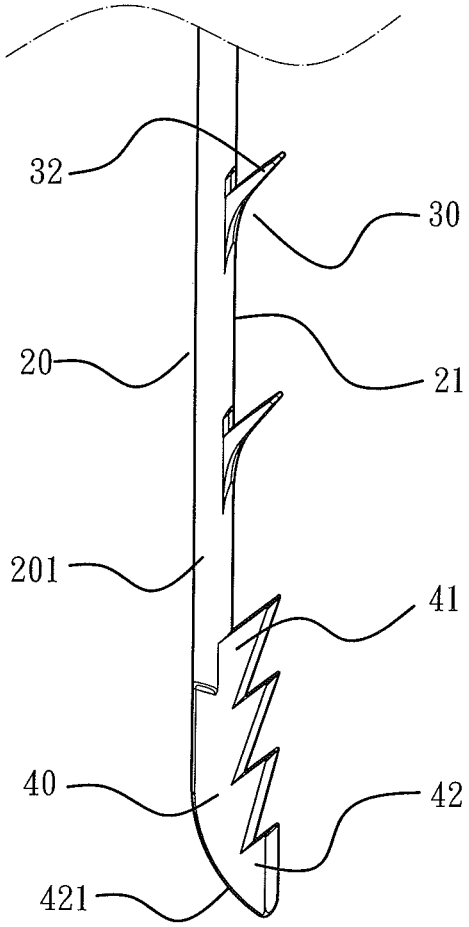
FIG. 2 is a partial enlargement view of the tool for removing hair from a drain of FIG. 1.
Figure 3:
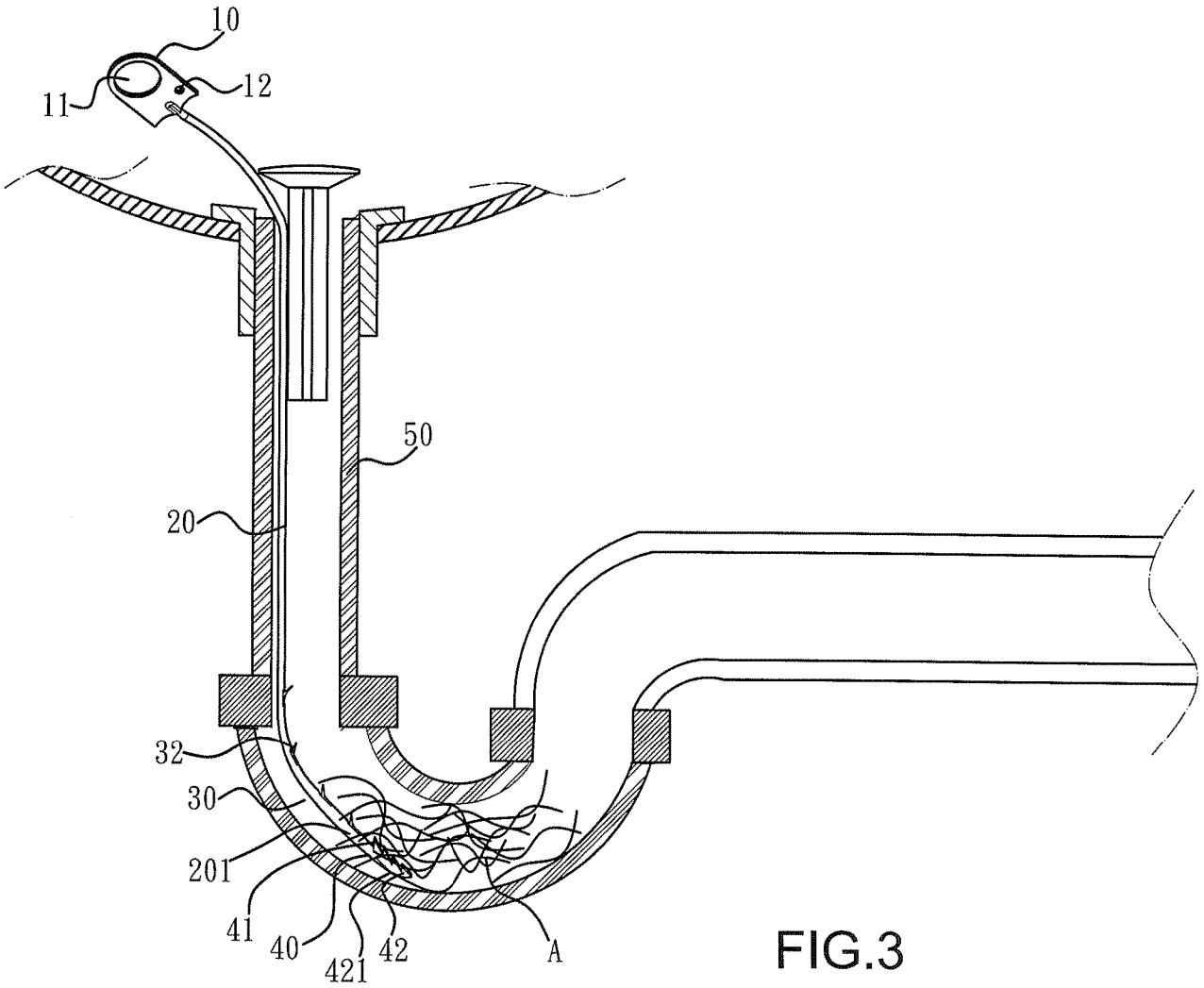
FIG. 3 is a schematic view which illustrates the tool for removing hair from a drain in FIG. 1 being operated.

A tool for removing hair from a drain according to a first embodiment of the present invention is shown in FIGS. 1 through 3 of the drawings and generally includes an elongate pole 20, a grappler part 40, a barb unit 30, and a handle 10. In this embodiment, the elongate pole 20 made of plastic is flexible. The elongate pole 20 includes a front end 201 and a rear end 202 spaced from the front end 201 in a lengthwise direction thereof.

The grappler part 40 is situated at the front end 201 of the elongate pole 20 and includes a head end 42 and at least one grappler 41. In this embodiment, the grappler part 40 includes a plurality of serrate grapplers 41 protruding from a side 21 of the elongate pole 20 and spaced from one another in the lengthwise direction of the elongate pole 20. Furthermore, the head end 42 of the grappler part 40 has a curved end plane 421.

The barb unit 30 is provided on the side 21 of the elongate pole 20 and is adjacent to the front end 201 of the elongate pole 20. In this embodiment, the barb unit 30 includes a plurality of barbs 32 protruding from the side 21 of the elongate pole 20. The barbs 32 are spaced from one another in the lengthwise direction of the elongate pole 20 and aligned with the grapplers 41 of the grappler part 40 along the side 21 in the lengthwise direction of the elongate pole 20. Furthermore, the elongate pole 20 has no barb 32 at the back opposite to the side 21 of the elongate pole 20.

The handle 10 is provided on the rear end 202 of the elongate pole 20 and used to be gripped by a user. In this embodiment, the handle 10 includes a hand hole 11 therein, a pointer 12, and two curved concaves 13 formed at a front end plane of the handle 10 and beside the rear end 202 of the elongate pole 20. The tool of the present invention can be easily drawn or pushed when a user grips the hand hole 11 or the curved concaves 13 by fingers. In this embodiment, the pointer 12 is a through-hole provided in the handle 10 and located at the same side of the elongate pole 20 with the grapplers 41 of the grappler part 40 and the barbs 32 of the barb unit 30. Namely, the pointer 12 is generally aligned with the grapplers 41 of the grappler part 40 and the barbs 32 of the barb unit 30 along the side 21 in the lengthwise direction of the elongate pole 20 for indicating orientation of the barbs 32 and the grapplers 41 of the grappler part 40 inside a drain.

As shown in FIG. 3, the tool of the present invention in practice allows the front end 201 of the elongate pole 20 to be inserted into a drain 50 which needs to be cleaned and allows the grappler part 40 to reach hair (A) inside the drain 50. The drain 50 congested with hair (A) is cleaned effectively when the tangled hair (A) is removed from the drain 50 by the grapplers 41 of the grappler part 40 and the barbs 32 of the barb unit 30, both of which spirally move with the elongate pole 20 back and forth and are taken out finally. Moreover, the tool of the present invention can be easily operated in drains with distinct calibers, because no barb 32 is provided on the back opposite to the side 21 of the elongate pole 20 and because the head end 42 is provided with the curved end plane 421.

In the first embodiment, all of the grappler part 40, the barb unit 30 and the handle 10 join the elongate pole 20. In a feasible embodiment, the grappler part 40, the barb unit 30, the handle 10 and the elongate pole 20, all of which are made of plastic, can be formed integrally. Furthermore, the curved end plane 421 of the head end 42 can be in the form of a slope.

Figure 4:
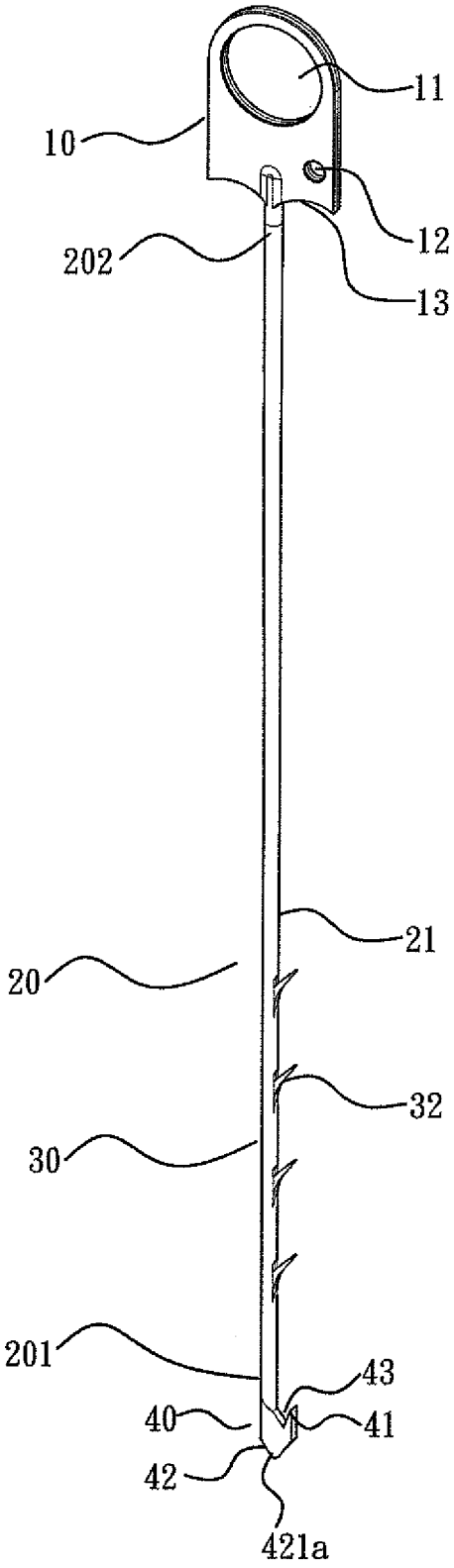
FIG. 4 is a schematic view of a tool for removing hair from a drain in accordance with a second embodiment of the present invention.

FIG. 4 illustrates a tool for removing hair from a drain in a second embodiment of the present invention. In this embodiment, the grappler part 40 has an arrowhead end plane 421*a* at the head end 42 and includes one grappler 41 protruding from the side 21 of the elongate pole 20. An open space 43 is defined between the grappler 41 and the side 21 of the elongate pole 20. The arrowhead end plane 421*a* assists the tool of the present invention in smoothly moving inside a drain when tangled hair is caught by the grappler part 40.

Figure 5:
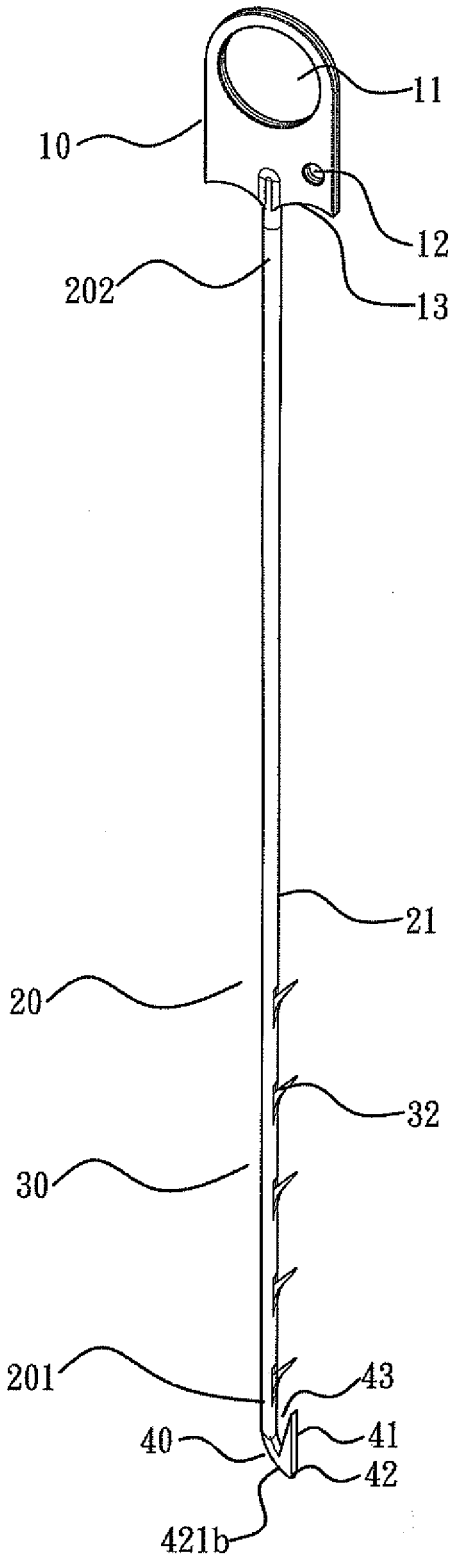
FIG. 5 is a schematic view of a tool for removing hair from a drain in accordance with a third embodiment of the present invention.

FIG. 5 illustrates a tool for removing hair from a drain in a third embodiment of the present invention. In this embodiment, the grappler part 40 has a hooked end plane 421*b* at the head end 42 and includes one grappler 41 for development of an open space 43 between the grappler 41 and the side 21 of the elongate pole 20. The hooked end plane 421*b* assists the tool of the present invention in smoothly moving inside a drain when tangled hair is caught by the grappler part 40.

Figure 6:
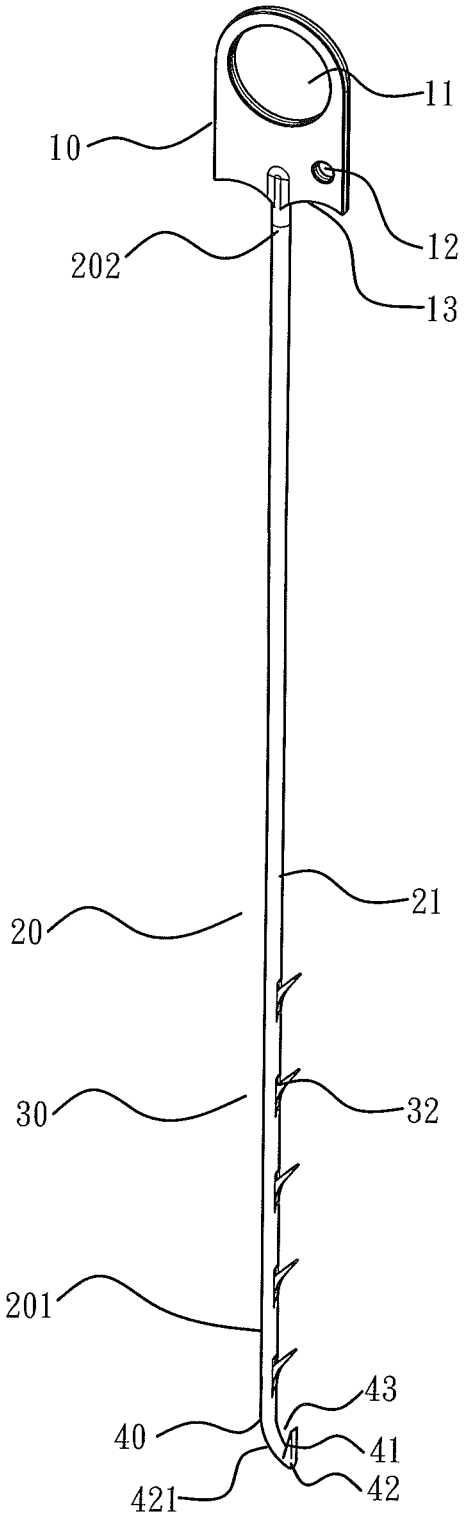
FIG. 6 is a schematic view of a tool for removing hair from a drain in accordance with a fourth embodiment of the present invention.

FIG. 6 illustrates a tool for removing hair from a drain in the fourth embodiment of the present invention. In this embodiment, the head end 42 and the grappler 41 of the grappler part 40 are integrally bent and extended upwardly from the front end 201 of the elongate pole 20 with the head end 42 having a curved end plane 421. An open space 43 is formed between the grappler 41 and the side 21 of the elongate pole 20. The curved end plane 421 assists the tool for removing hair from a drain of the present invention in smoothly moving inside a drain when tangled hair is caught by the grappler 41.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A tool for removing hair from a drain comprising:

an elongate pole including a front end and a rear end spaced from the front end along a lengthwise axis of the elongate pole;

a grappler part provided at the front end of the elongate pole and including a head end and at least one grappler which protrudes from a barb side of the elongate pole, with the head end of the grappler part having a curved end plane;

a barb unit provided on the barb side of the elongate pole and being adjacent to the front end of the elongate pole, with the barb unit including a plurality of barbs spaced from one another along the lengthwise axis of the elongate pole and aligned with the at least one grappler of the grappler part along the barb side of the elongate pole, wherein the elongate pole has no barb at a back opposite to the barb side of the elongate pole; and a handle provided at the rear end of the elongate pole and including a pointer for indicating orientation of the plurality of barbs and the at least one grappler of the grappler part, wherein the handle includes a hand hole centered on the lengthwise axis and two curved concaves formed on opposite sides of the lengthwise axis at a front end plane of the handle and beside the rear end of the elongate pole, wherein the pointer is a through-hole provided in the handle and generally aligned with the barbs of the barb unit along the barb side of the elongate pole, with the through-hole of a size smaller than the hand hole and located exclusively on one of the opposite sides of the handle.

2. A tool for removing hair from a drain comprising:

an elongate pole including a front end and a rear end spaced from the front end along a lengthwise axis of the elongate pole;

a grappler part provided at the front end of the elongate pole and including a head end and at least one grappler which protrudes from a barb side of the elongate pole, with the head end of the grappler part having an arrowhead end plane, with an open space formed between the at least one grappler and the barb side of the elongate pole;

a barb unit provided at the elongate pole and being adjacent to the front end of the elongate pole, with the barb unit including a plurality of barbs which are spaced from one another along the lengthwise axis of the elongate pole and aligned with the at least one grappler of the grappler part along the barb side of the elongate pole, wherein the elongate pole has no barb at a back opposite to the barb side of the elongate pole; and a handle provided at the rear end of the elongate pole and including a pointer for indicating orientation of the plurality of barbs and the at least one grappler of the grappler part, wherein the handle includes a hand hole centered on the lengthwise axis and two curved concaves formed on opposite sides of the lengthwise axis at a front end plane of the handle and beside the rear end of the elongate pole, wherein the pointer is a through-hole opened in the handle and generally aligned with the barbs of the barb unit along the barb side of the elongate pole, with the through-hole of a size smaller than the hand hole and located exclusively on one of the opposite sides of the handle.

3. A tool for removing hair from a drain comprising:

an elongate pole including a front end and a rear end spaced from the front end along a lengthwise axis of the elongate pole;

a grappler part provided at the front end of the elongate pole and including a head end and at least one grappler which protrudes from a barb side of the elongate pole, with the head end of the grappler part having a hooked end plane, with an open space formed between the at least one grappler and the barb side of the elongate pole;

a barb unit provided at the elongate pole and being adjacent to the front end of the elongate pole, with the barb unit including a plurality of barbs which are spaced from one another along the lengthwise axis of the elongate pole and aligned with the at least one grappler of the grappler part along the barb side of the elongate pole, wherein the elongate pole has no barb at a back opposite to the barb side of the elongate pole; and a handle provided at the rear end of the elongate pole and including a pointer for indicating orientation of the plurality of barbs and the at least one grappler of the grappler part, wherein the handle includes a hand hole centered on the lengthwise axis and two curved concaves formed on opposite sides of the lengthwise axis at a front end plane of the handle and beside the rear end of the elongate pole, wherein the pointer is a through-hole opened in the handle and generally aligned with the barbs of the barb unit along the barb side of the elongate pole, with the through-hole of a size smaller than the hand hole and located exclusively on one of the opposite sides of the handle.

* * * * *